US011815323B2

(12) United States Patent
Kolev et al.

(10) Patent No.: US 11,815,323 B2
(45) Date of Patent: Nov. 14, 2023

(54) ADJUSTABLE FORCE TRIGGER MECHANISM

(71) Applicant: Savage Arms, Inc., Westfield, MA (US)

(72) Inventors: Ivan N. Kolev, Suffield, CT (US); Joseph D. Salvador, Wilbraham, MA (US)

(73) Assignee: Savage Arms, Inc., Westfield, MA (US)

( * ) Notice: Subject to any disclaimer, the term of this patent is extended or adjusted under 35 U.S.C. 154(b) by 95 days.

(21) Appl. No.: 17/229,317

(22) Filed: Apr. 13, 2021

(65) Prior Publication Data

US 2021/0341243 A1 Nov. 4, 2021

Related U.S. Application Data

(63) Continuation of application No. 16/657,893, filed on Oct. 18, 2019, now Pat. No. 10,976,124.

(60) Provisional application No. 62/747,372, filed on Oct. 18, 2018.

(51) Int. Cl.
*F41A 19/16* (2006.01)
*F41A 19/10* (2006.01)

(52) U.S. Cl.
CPC ..... *F41A 19/16* (2013.01); *F41A 19/10* (2013.01)

(58) Field of Classification Search
CPC ..... F41A 19/16; F41A 19/10; F41A 19/17
USPC ..... 42/69.01
See application file for complete search history.

(56) References Cited

U.S. PATENT DOCUMENTS 1,215,181 A 2/1917 Newton
2,156,191 A * 4/1939 Pike ..... F41A 19/31 42/69.02
2,557,415 A * 6/1951 Dayton ..... F41A 19/16 42/69.01
2,984,037 A * 5/1961 Wilhelm ..... F41A 19/16 42/69.03

(Continued)

FOREIGN PATENT DOCUMENTS

DE 2053006 A1 10/1970
DE 202018103755 U1 9/2018

(Continued)

OTHER PUBLICATIONS

International Search Report for Application No. PCT/US19/57079 dated Feb. 27, 2020 (2 pages).

*Primary Examiner* — Joshua E Freeman
(74) *Attorney, Agent, or Firm* — Christensen, Fonder, Dardi & Herbert PLLC; Douglas J. Christensen

(57) ABSTRACT

A trigger assembly having a user-adjustable actuation force. The trigger assembly includes a trigger and indexing pin that are rotatable about a pivot axis and mounted to a locking block of a firearm. A torsion spring bridges the indexing pin and the locking block. Rotation of the indexing pin in a first rotational direction increases the actuation force of the trigger assembly, while rotation of the indexing pin in a second, opposite rotational direction decreases the actuation force. The end user is able to adjust the actuation force of the trigger without procuring additional components and without requiring the services of a locksmith. A safety trigger has a lower pivot point on the trigger and provides a stop that prevents retraction of the trigger unless the safety trigger is retracted first.

18 Claims, 8 Drawing Sheets

(56) References Cited

U.S. PATENT DOCUMENTS

| | | | | | |
|---|---|---|---|---|---|
| 3,830,002 | A * | 8/1974 | Volkmar | F41A 17/72 | 42/70.08 |
| 3,863,375 | A | 2/1975 | Browning | | |
| 4,058,924 | A * | 11/1977 | Mullner | F41A 19/17 | 42/69.01 |
| 4,109,402 | A * | 8/1978 | Guardamino | F41A 19/16 | 42/69.01 |
| 4,152,856 | A * | 5/1979 | Tollinger | F41A 19/16 | 42/69.01 |
| 4,691,461 | A * | 9/1987 | Behlert | F41A 19/10 | 42/69.01 |
| 4,937,964 | A | 7/1990 | Crandall | | |
| 4,987,693 | A | 1/1991 | Brooks | | |
| 5,074,190 | A * | 12/1991 | Troncoso | F41A 19/10 | 42/69.01 |
| 5,086,579 | A | 2/1992 | Flatley et al. | | |
| 5,501,134 | A * | 3/1996 | Milazzo | F41A 19/45 | 89/139 |
| 6,131,324 | A * | 10/2000 | Jewell | F41A 19/16 | 89/139 |
| 6,553,706 | B1 * | 4/2003 | Gancarz | F41A 17/46 | 42/70.01 |
| 6,615,527 | B1 * | 9/2003 | Martin | F41A 19/46 | 89/154 |
| 6,772,548 | B1 * | 8/2004 | Power | F41A 19/10 | 89/139 |
| 6,843,013 | B2 * | 1/2005 | Cutini | F41A 17/46 | 42/70.01 |
| 7,165,352 | B2 | 1/2007 | Langlotz | | |
| 7,188,561 | B1 * | 3/2007 | Kelbly | F41A 19/16 | 89/136 |
| 7,293,385 | B2 | 11/2007 | McCormick | | |
| D597,626 | S * | 8/2009 | Krieger | D22/108 | |
| 7,930,848 | B2 | 4/2011 | Dye, Jr. | | |
| 8,220,193 | B1 * | 7/2012 | Lynch | F41A 19/16 | 42/70.08 |
| 8,250,799 | B2 * | 8/2012 | Duperry | F41A 19/16 | 42/42.02 |
| 9,046,313 | B1 * | 6/2015 | Lutton | F41A 19/14 | |
| 9,222,745 | B2 | 12/2015 | Kallio | | |
| 9,383,153 | B2 | 7/2016 | Nebeker et al. | | |
| 9,389,037 | B2 | 7/2016 | Reynolds | | |
| 9,605,917 | B2 * | 3/2017 | Withey | F41A 19/16 | |
| 9,618,288 | B2 | 4/2017 | Wilson | | |
| 9,658,007 | B2 | 5/2017 | Withey | | |
| 9,810,496 | B2 | 11/2017 | Kolev et al. | | |
| 9,970,723 | B1 | 5/2018 | Findlay et al. | | |
| 9,970,724 | B1 | 5/2018 | Acker | | |
| 10,006,734 | B1 | 6/2018 | Findlay | | |
| 10,030,927 | B1 | 7/2018 | Theiss | | |
| 10,156,409 | B1 | 12/2018 | Laney et al. | | |
| 10,295,286 | B1 | 5/2019 | Withey | | |
| 10,731,937 | B2 * | 8/2020 | Schacht | F41A 19/15 | |
| 10,809,031 | B2 * | 10/2020 | Geissele | F41A 19/43 | |
| 2006/0101693 | A1 * | 5/2006 | Langlotz | F41A 19/16 | 42/69.01 |
| 2008/0185415 | A1 * | 8/2008 | Huang | B25C 1/04 | 227/8 |
| 2012/0005934 | A1 * | 1/2012 | Doll | F41A 17/58 | 42/69.01 |
| 2012/0174453 | A1 | 7/2012 | Kallio | | |
| 2012/0204462 | A1 * | 8/2012 | Pflaumer | F41A 19/44 | 42/69.01 |
| 2013/0062390 | A1 | 3/2013 | Yeh | | |
| 2013/0104436 | A1 | 5/2013 | Heizer | | |
| 2015/0253094 | A1 * | 9/2015 | Reynolds | F41A 19/10 | 42/69.01 |
| 2019/0368835 | A1 * | 12/2019 | Schacht | F41A 19/14 | |
| 2020/0124370 | A1 * | 4/2020 | Kolev | F41A 19/10 | |
| 2020/0248979 | A1 * | 8/2020 | Dunham | F41C 7/06 | |

FOREIGN PATENT DOCUMENTS

| | | |
|---|---|---|
| FR | 1446514 | 7/1966 |
| WO | WO 2007/030845 | 3/2007 |

* cited by examiner

ADJUSTABLE FORCE TRIGGER MECHANISM

RELATED APPLICATIONS

This application is a continuation of U.S. application Ser. No. 16/657,893, filed Oct. 18, 2019, which claims the benefit of U.S. Provisional Patent Application No. 62/747,372, filed Oct. 18, 2018, the disclosures of which are hereby incorporated by reference in their entireties.

BACKGROUND OF THE DISCLOSURE

Pistols typically ship from the factory having a fixed trigger actuation force. End users who want to change the trigger actuation force must often purchase additional springs and components and utilize the services of a gunsmith to install and tune the pistol. In many cases, modifying a firearm in any way potentially voids the warranty and can create an unsafe situation for the end user. A trigger system that enables the end user to adjust the trigger actuation force without the services of a gunsmith while maintaining safe operation of the sidearm would be welcomed.

SUMMARY OF THE DISCLOSURE

Various embodiments of the disclosure include a trigger assembly that enables a high level of user adjustment without the services of a gunsmith and without compromising the safe operation of the firearm. The trigger assembly is compact in design, suitable for implementation in sidearms such has pistols and hand guns. An end user can fine tune the trigger actuation force to their preference or depending on the application without having to purchase additional components or perform modifications to the firearm. Adjustment of the trigger actuation force is desirable because different shooting disciplines require different trigger actuation forces. For example, for firearms utilized in competition, a trigger actuation force in a range of 2 pounds-force (lbf) to 4 lbf is often preferred; for standard duty and carry, a trigger actuation force in a range of 4 lbf to 7 lbf is often preferred; for many state law enforcement agencies, a trigger actuation force of 10 lbf is required.

Structurally, the disclosed adjustable force trigger mechanism is packaged as a locking block and trigger assembly. The assembly includes a torsion spring that bridges the locking block and trigger and is retained by an indexing pin. The indexing pin can be rotated to tighten or loosen the torsion spring, thereby increasing or decreasing the actuation force required to actuate the trigger.

Various embodiments of the disclosure are directed to a trigger assembly with adjustable actuation force for a firearm, comprising a trigger mount defining a lateral bore about a pivot axis, an indexing pin mounted to the trigger mount within the lateral bore, a trigger supported by the indexing pin, the trigger and the indexing pin being rotatable about the pivot axis, and a torsion spring including a first end coupled to the indexing pin and a second end coupled to the trigger mount, the torsion spring configured to apply a biasing force that opposes actuation of the trigger. Rotation of the indexing pin in a first rotational direction within the lateral bore increases the biasing force, and rotation of the indexing pin in a second rotational direction within the lateral bore decreases the biasing force, the second rotational direction being opposite the first rotational direction. In some embodiments, the firearm is a sidearm.

The lateral bore may define an inner diameter, and wherein indexing pin includes a distal end that forms a close, sliding fit within the inner diameter, the distal end of the indexing pin being rotatable within the inner diameter. In some embodiments, the lateral bore defines a major diameter and a minor diameter. The indexing pin may include a shaft portion having a distal end, the distal end forming a close, sliding fit within the minor diameter and being rotatable within the minor diameter. In some embodiments, the torsion spring is a coil spring surrounding the shaft portion, and may be housed within the major diameter. The shaft portion of the indexing pin may define a pin keyway that extends parallel to a central axis of the shaft portion. In some embodiments, the trigger mount defines a bore keyway adjacent the lateral bore and extends parallel to the pivot axis. The first end of the torsion spring may be disposed in the pin keyway and the second end of the torsion spring disposed in the bore keyway.

In some embodiments, the indexing pin includes a head portion. The head portion may include a tool feature for mating with an external tool, and be rotatable within the major diameter of the lateral bore. In some embodiments, the head portion includes a detent and the trigger defines a notch, the detent being configured to engage the notch to secure the indexing pin and the trigger in a fixed rotational relationship. In some embodiments, the head portion defines a polygonal cross-section and the trigger defines a complementary polygonal recess, the polygonal cross-section being configured to engage the complementary polygonal recess to secure the indexing pin and the trigger in a fixed rotational relationship.

In some embodiments, the trigger includes a finger hook portion that depends from a bracket portion, the bracket portion including a first ear portion that defines a first lateral through passage and a second ear portion that defines a second lateral through passage, the first lateral through passage and the second lateral through passage being concentric about the pivot axis. The trigger assembly may be configured for insertion into and removal from a receiver of a firearm.

Various embodiments of the disclosure are directed to a method for adjusting an actuation force of a trigger assembly for a firearm, comprising: providing a kit including a trigger assembly; and providing instructions on a tangible, non-transitory medium. The instructions may include: rotating an indexing pin within a trigger of the trigger assembly from a first rotational position to a second rotational position to change a torsional tension of a torsion spring of the trigger assembly, the trigger being rotatable about the indexing pin of the trigger assembly for actuating a firearm, the torsion spring being coupled to the indexing pin and the trigger; and securing the indexing pin to the trigger in the second rotational position. In some embodiments, the instructions include removing the trigger assembly from the firearm prior to the step of releasing. The instructions may include replacing the trigger assembly within the firearm after the step of securing. In some embodiments, the instructions in the step of providing instructions includes inserting the torsion spring into the trigger prior to the step of rotating the indexing pin. The instructions in the step of providing instructions may include releasing the indexing pin from the trigger of the trigger assembly prior to the step of rotating the indexing pin.

A feature and advantage of embodiments is a user adjustable pull force on a trigger mechanism.

A feature and advantage of embodiments is a simple safety trigger of minimal components.

A feature and advantage of embodiments is an adjustable pull mechanism where a spring controlling the trigger pull force is contained within a closed cavity substantially precluding any debris or other material from interfering with the spring operation.

DETAILED DESCRIPTION OF THE FIGURES

Figures 1, 2:
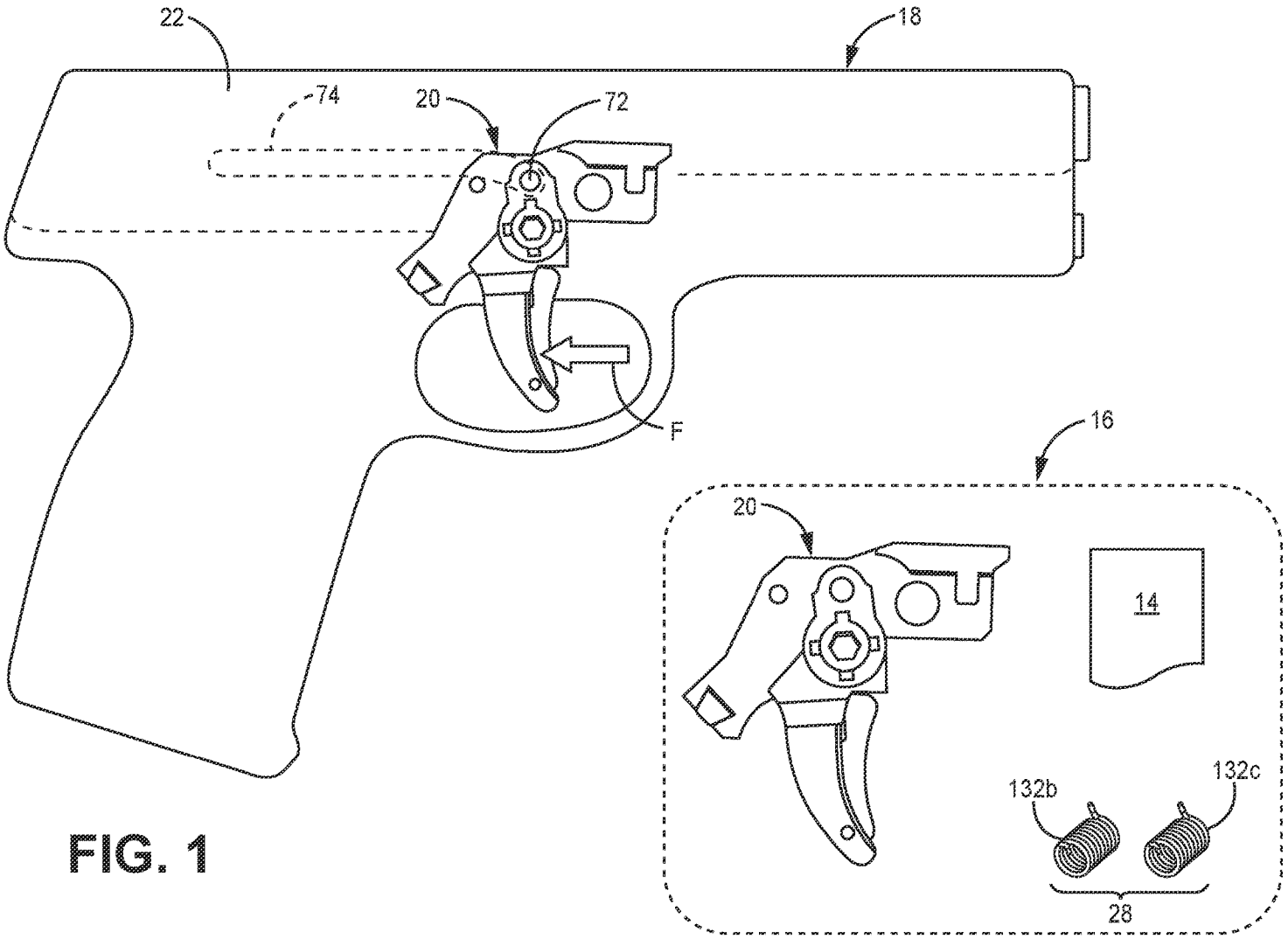
FIG. 1 is a side view of a trigger assembly as mounted in the outline of a firearm according to an embodiment of the disclosure.
FIG. 2 is a schematic of a kit including the trigger assembly of FIG. 1 according to an embodiment of the disclosure.

Referring to FIGS. 1 and 2, a trigger assembly 20 is depicted according to embodiments of the disclosure. In FIG. 1, the trigger assembly 20 is superimposed over a representative image of a firearm 18 and is part of the firearm firing mechanism 22 shown schematically. An actuation force F is required to actuate the trigger assembly 20 and activate the firearm 18. While the depicted firearm 18 is a pistol, the trigger assembly 20 may also be utilized in a long gun (not depicted). In FIG. 2, the trigger assembly 20 is depicted as part of a kit 16 including spare torsion springs 28 and instructions 14 for assembly or operation. In some embodiments, the kit 16 is provided for retrofitting of an existing firearm 18. In some embodiments, the kit 16 includes the firearm 18.

Referring to FIGS. 3 through 7, the trigger assembly 20 for insertion into the firearm is depicted in greater detail according to an embodiment of the disclosure. The trigger assembly 20 includes a trigger support frame configured as a locking block 22 to which a trigger 24 is pivotally mounted about an indexing pin 26. A torsion spring 28 bridges the trigger 24 and the locking block 22.

The locking block 22 defines a lateral bore 42 into which the indexing pin 26 is inserted. The lateral bore 42 defines a bore axis 44 and a cavity 45 conformingly sized for the torsion spring 28, the bore passes laterally through the locking block 22. In some embodiments, the lateral bore 42 defines a major diameter 46 accessible from a first side 48 of the locking block 22 and reduces to a minor diameter 52 on a second or opposing side 54 of the locking block 22. A bore keyway 56 may extend radially from the major diameter 46 of the lateral bore 42 and parallel to the bore axis 44.

The trigger 24 includes a bracket portion 62 and a finger hook portion 64. The bracket portion 62 includes first and second ear portions 66 and 68 that are laterally spaced to straddle the locking block 22 at the bore axis 44 defining a yoke about the trigger support frame 22. The trigger 24 may also include a safety trigger 70 that is nested or otherwise adjacent the finger hook portion 64 of the main trigger 24 with an embodiment discussed in detail below. The structure and function of representative safety triggers suitable herein are explained, for example, at U.S. Pat. No. 9,810,496 to Kolev et al., U.S. Pat. No. 9,658,007 to Withey, and U.S. Pat. No. 6,553,706 to Gancarz et al., all of which are assigned to the owner of the present application, and the disclosures of which are hereby incorporated by reference herein in their entirety except for express definitions and patent claims contained therein. Other references describing representative safety triggers 70 that may be utilized include U.S. Pat. No. 6,843,013 to Cutini et al., U.S. Pat. No. 8,220,193 to Lynch, U.S. Pat. No. 8,250,799 to Duperry et al., U.S. Pat. No. 9,046,313 to Lutton et al., U.S. Pat. No. 9,222,745 to Kallio, U.S. Pat. No. 9,383,153 to Nebeker et al., U.S. Pat. No. 9,970,723 to Findlay et al., U.S. Pat. No. 9,970,724 to Acker, U.S. Pat. No. 10,006,734 to Findlay, U.S. Pat. No. 10,030,927 to Theiss, and U.S. Pat. No. 10,156,409 to Laney et al., the disclosures of which are hereby incorporated by reference herein in their entirety except for express definitions and patent claims contained therein.

As best shown in FIGS. 1 and 3-5, the trigger 24, in an embodiment, has an upper arm 71 with a lug 72 that may be linked to the other portions of the firearm firing mechanism 72 such as with a trigger bar 74, present in many semiautomatic handguns. Any of various known firing mechanisms actuated by a trigger that rotates about a pivot axis may be suitable for the adjustable trigger mechanism and safety trigger herein and the disclosure is not intended to be limited to firearms with firing mechanisms having, for example, trigger bars.

In some embodiments, the first and second ear portions 66 and 68 define first and second lateral through passages 82 and 84, respectively, that are concentric about a pivot or actuation axis 86. The first lateral through passage 82 of the first ear portion 66 may be sized to match the major diameter 46 of the lateral bore 42 of the locking block 22, and the second lateral through passage 84 of the second ear portion 68 may be sized to match the minor diameter 52 of the lateral bore 42. In some embodiments, the first ear portion 66 defines one or more notches 88 that extend radially from the first lateral through passage 82. The first ear portion 66 may include a collar 92 that projects laterally outward, the collar 92 defining the notch(es) 88.

The indexing pin 26 includes a shaft portion 102 and a head portion 104 concentric about a central axis 106, the central axis 106 being substantially parallel to or concentric with the bore axis 44 and the pivot axis 86 when the trigger assembly 20 is fully assembled. The shaft portion 102 may be dimensioned at a distal end 112 to provide a close, sliding fit within the minor diameter 52 of the lateral bore 42. The head portion 104 is dimensioned to fit within the first lateral through passage 82 of the first ear portion 66 and the major diameter 46 of the lateral bore 42 of the locking block 22. In some embodiments, the head portion 104 includes at least one detent 114 that projects radially. The detent 114 is dimensioned to laterally slide into the notch(es) 88. The shaft portion 102 may define a pin keyway 116 that extends parallel to the central axis 106. In some embodiments, the head portion 104 defines a tool feature 118 for coupling with a tool, for example, a hexagonal socket 122 for mating with a hexagonal wrench. The tool feature 118 may be sized for mating with tools other than a hexagonal wrench, e.g., a straight slot for mating with a flat head screw driver, cross slots for mating with a PHILLIPS screw driver, or a starred socket for mating with a TORX® bit.

In some embodiments, the torsion spring 28 is a coil spring 132*a* that coils around the indexing pin 26 and defines an inner coil diameter 134 and an outer coil diameter 136. The coil spring 132*a* includes a first end leg 142 that extends radially inward from the inner coil diameter 134 and a second end leg 144 that extends radially outward from the outer coil diameter 136.

To assemble the trigger assembly 20, the coil spring 132*a* is inserted into the major diameter 46 of the lateral bore 42 of the locking block 22 and slide in a second lateral direction 146 toward the second side 54, so that the second end leg 144 extends into the bore keyway 56 that extends parallel to the lateral bore 42. The trigger 24 is positioned so that the pivot axis 86 of the trigger 24 aligned with the bore axis 44 of the lateral bore 42. The indexing pin 26 is positioned and rotated so that the pin keyway 116 is aligned with the first end leg 142 of the coil spring 132*a*, and the indexing pin 26 inserted into the lateral bore 42 so that the distal end 112 of the shaft portion 102 is inserted into the minor diameter 52 of the lateral bore 42 and the head portion 104 of the indexing pin 26 enters the major diameter 46 of the first ear portion 66. With the second end leg 144 of the coil spring 132*a* lodged in the bore keyway 56 and the first end leg 142 of the coil spring 132*a* lodged in the pin keyway 116, the indexing pin 26 is rotated so that the detent 114 on the head portion 104 is aligned with one of the notches 88 of the first ear portion 66 and the indexing pin 26 pushed further into the first lateral through passage 82 and lateral bore 42 so that the detent 114 is registered within the notch 88. The trigger assembly 20 is then mounted into a receiver 150 (depicted in phantom in FIG. 5) of the firearm 16. The indexing pin 26 is thereby effectively captured within the trigger assembly 20 by the receiver 150.

In operation, to adjust the actuation force F, the indexing pin 26 is released from the trigger 24, rotated to change the torsional tension of the torsion spring 28, and secured to the trigger 24. In some embodiments, the indexing pin 26 is slid within the lateral bore 42 in a first lateral direction 148 so that the head portion 104 protrudes partially out of the first ear portion 66, far enough so that the detent 114 is removed from the notch 88. The indexing pin 26 may then be rotated about the central axis 106 to tighten or loosen the coil spring 132*a*. In this way, the torsion spring 28 (e.g., the coil spring 132*a*) can remain within the trigger assembly 20 (e.g., within the lateral bore 42) during the tension adjustment operation without being removed from the trigger assembly 20, enabling the user to readily loosen or tighten the trigger actuation force F relative to the previous setting without need for independently tracking the previous tension setting. In some embodiments, the trigger assembly 20 is removed from the receiver 150 to perform the adjustment; in other embodiments, the indexing pin 26 is accessible without need for removing the trigger assembly 20 from the firearm 18.

Optionally, the torsion spring 28 (e.g., coil spring 132*a*) may be removed and replaced with another torsion spring (e.g., coil spring 132*b*) of similar construction (FIG. 2). Herein, coil spring(s) are identified generically or collectively by the reference character 132 (e.g., "coil spring(s) 132"), and specifically or individually by the reference character 132 followed by a letter suffix (e.g., "coil spring 132*b*"). In some embodiments, the replacement coil spring 132*b* includes the same physical features as the coil spring 132*a* that enables ready exchange within the trigger assembly 20 (e.g., the first end leg 142 that extends radially inward from an inner coil diameter 134 and the second end leg 144 that extends radially outward from an outer coil diameter 136). However, the replacement coil spring 132*b* may possess a torsional spring constant K that is different than for the spring coil 132*a* that it replaces. The torsional spring constant K has units of torsion per unit of rotation (e.g., Newton-meters/radian), such that a higher torsional spring constant K requires more force to rotationally displace the spring coil 132 than does a lower torsional spring constant K. The torsional spring constant K of the coil spring(s) 132 may be affected, for example, by changing one or more of the material, wire diameter, and number of turns in the coil of the replacement coil spring 132*b* relative to the coil spring 132*a*. For example, a replacement coil spring 132*b* made of a material having a higher elastic modulus, a greater diameter wire gauge, a fewer number of coil turns, or a combination thereof than for the coil spring 132*a* it replaces will have a higher torsional spring constant K, thereby requiring more force to actuate the trigger 64. In contrast, the replacement coil spring 132*b* made of a material having a lower elastic modulus, a smaller diameter wire gauge, a greater number of coil turns, or a combination thereof than for the coil spring 132*a* it replaces will have a lower torsional spring constant K, thereby requiring less actuation force F to actuate the trigger 64. In some embodiments, a plurality of replacement coil springs 132*b*, 132*c* (FIG. 2) may be interchangeable with the coil spring 132*a*.

Figure 4:
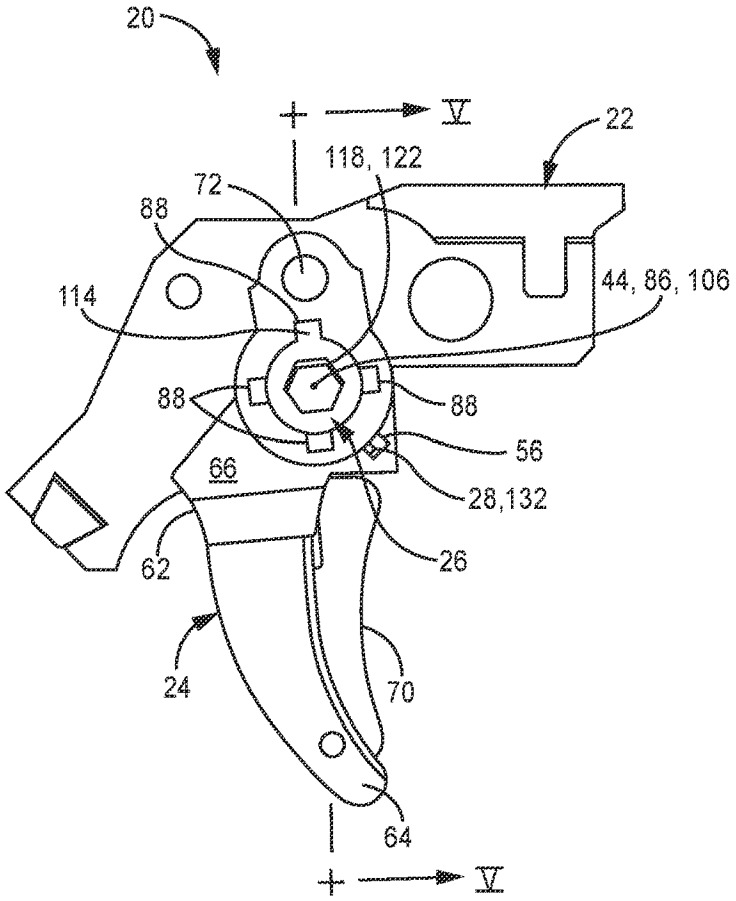
FIG. 4 is a side elevational view of the trigger assembly of FIG. 1 according to an embodiment of the disclosure.
Figure 3:
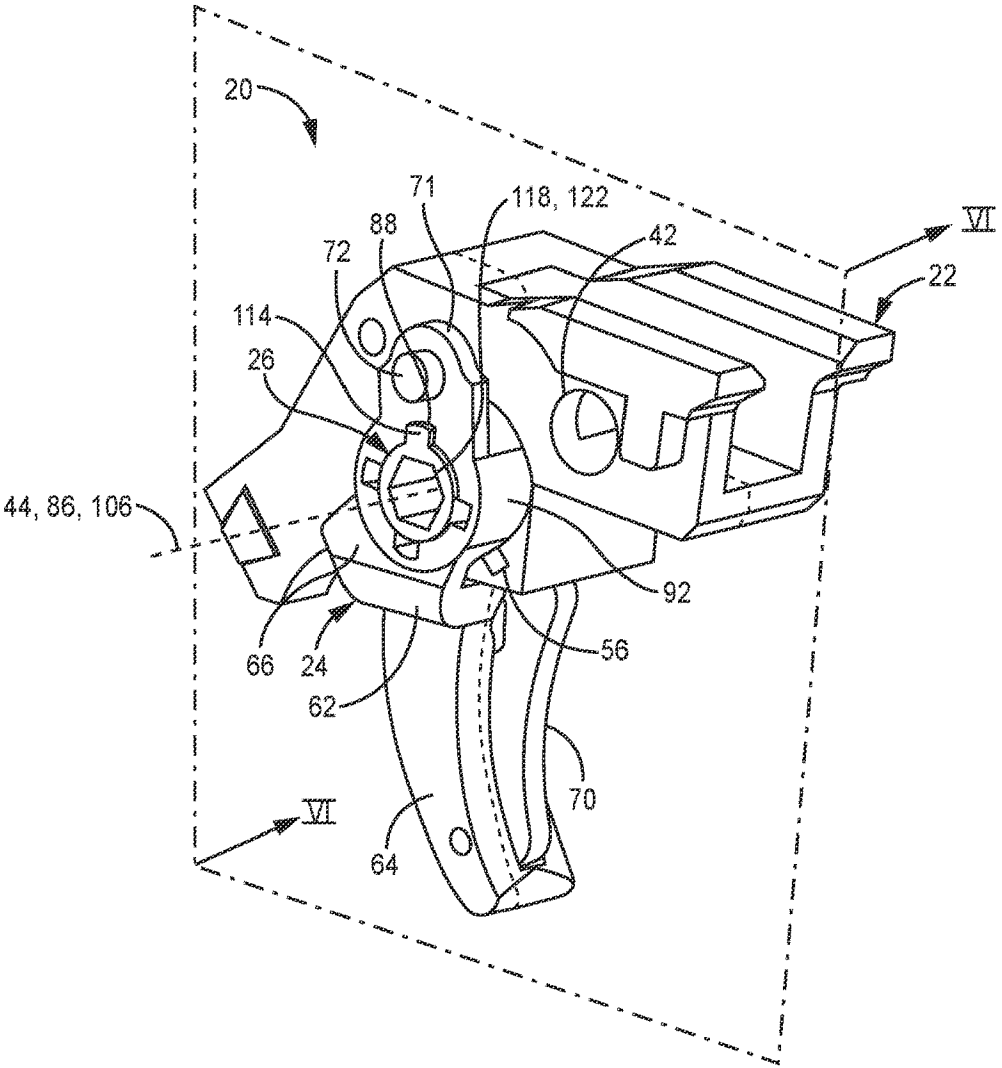
FIG. 3 is an upper perspective view of the trigger assembly of FIG. 1 according to an embodiment of the disclosure.
Figure 6:
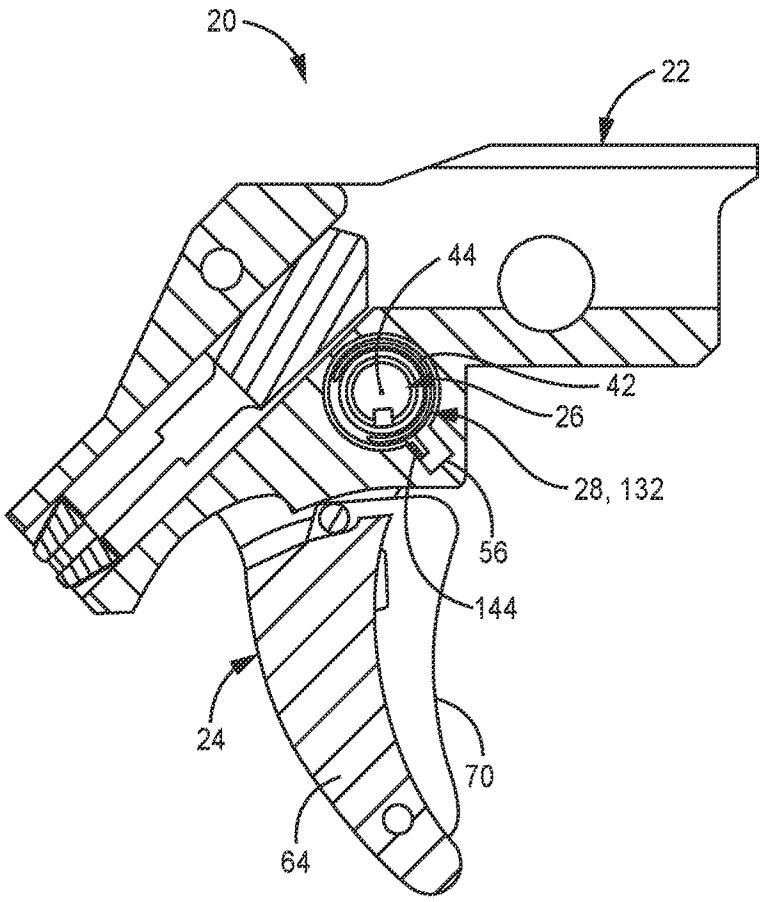
FIG. 6 is a sectional view at plane VI-VI of FIG. 3 according to an embodiment of the disclosure.

For the depicted embodiment, rotation of the indexing pin 26 in a clockwise direction as viewed in FIG. 4 acts to tighten the coil spring 132 about the shaft portion 102, thereby increasing the force required to actuate the trigger assembly 20. As such, also for the depicted embodiment, rotation of the indexing pin 26 in a counterclockwise direction as viewed in FIG. 4 acts to loosen the coil spring 132 about the shaft portion 102, thereby decreasing the force required to actuate the trigger assembly 20.

In some embodiments, the trigger assembly 20 or kit 16 enables the trigger actuation forces F to be set within a range of 1 lbf to 12 lbf inclusive; in some embodiments, a range of 2 lbf to 10 lbf inclusive; in some embodiments, a range of 4 lbf to 7 lbf inclusive; in some embodiments, a range of 2 lbf to 4 lbf inclusive; in some embodiments, a range of 6 ounces of force to 5 lbf inclusive. Herein, a range that is said to be "inclusive" includes the end point values of the stated range as well as all values therebetween.

In some embodiments, the various operational steps and characteristics described above are included in the instructions 14 for assembly or operation. The instructions 14 may be provided on a tangible, non-transitory medium. Non-limiting examples of a tangible, non-transitory medium include a paper document and computer-readable media including compact disc and magnetic storage devices (e.g., hard disk, flash drive, cartridge, floppy drive). The computer-readable media may be local or accessible over the internet. The instructions 14 may be complete on a single medium, or divided among two or more media. For example, some of the instructions 14 may be written on a paper document that instruct the user to access one or more of the steps of the method over the internet, the internet-accessible steps being stored on a computer-readable medium or media. The instructions 14 may be in the form of written words, figures, and/or video presentations.

Functionally, disposing the end legs 142 and 144 of the coil spring 132 within the keyways 116 and 56 enables the indexing pin 26 to be translated laterally within the lateral bore 42 without stretching or compressing the coil spring 132 and generating an attendant opposing force. This enables better control of the indexing pin 26 when adjusting the actuation force F. The collar 92, though not necessary, may provide a deeper notch for securing the detent 114 during transfer and mounting of the trigger assembly 20 to the receiver 150. The tool feature 118 provides a way to manipulate and rotate the indexing pin 26 during adjustment of trigger actuation force F (e.g., using a hexagonal wrench seated in the depicted hexagonal socket 122).

By exchanging the coil spring 132, the adjustment characteristics of the actuation force F may be altered. For example, by replacing the coil spring 132*a* with a replacement coil spring 132*b* having a higher torsional spring constant, the change in the actuation force F per incremental rotation of the coil spring 132*b* is increased, thereby increasing the range of the available actuation forces F. By replacing the coil spring 132*a* with a replacement coil spring 132*c* having a lower torsional spring constant, the change in the actuation force F per incremental rotation of the coil spring 132*c* is decreased, thereby increasing the resolution of the trigger actuation force adjustment. For embodiments where a plurality of replacement coil springs 132 are available, the user or retailer can, for example, alter the available ranges of the actuation force F to suit personal or targeted demographic preferences, or provide greater adjustment resolution over a plurality of actuation force ranges. In the depicted embodiment, there are four notches 88 uniformly distributed about the bore axis 44, such that the detent 114 realigns with one of the notches 88 for every 90 degrees of rotation about the central axis 106. Accordingly, the end user can reset the indexing pin 26 after a quarter turn for the depicted embodiment. The inner coil diameter 134 may be sized large enough relative to the outer diameter of the shaft portion 102 and the outer coil diameter 136 may be sized small enough relative to the inner diameter of the lateral bore 42 to enable radial contraction and expansion of the coil spring 132 over several incremental rotations of the indexing pin 26 in both rotational directions. After rotating the indexing pin 26 for one or more incremental rotations, the detent 114 is aligned for seating within one of the notches 88. In some embodiments, upon securing the indexing pin 26 within the notch 88, the trigger assembly 20 is returned to the receiver 150.

The use of more or less than four notches 88 is also contemplated. Using only one notch, for example, limits the incremental rotation of the indexing pin 26 about the central axis 106 to full turns. The greater the number of the plurality of notches 88, the greater the resolution of the trigger actuation force adjustment. For example: two notches 88 may be defined at 180 degree rotational increments, enabling the indexing pin 26 to be reset in ½ turns; three notches 88 may be defined at 120 degree rotational increments to enable the indexing pin 26 to be reset in ⅓ turns; six notches may be defined at 60 degree rotational increments to enable the indexing pin 26 to be reset in ⅙ turns; and so on.

Figure 5:
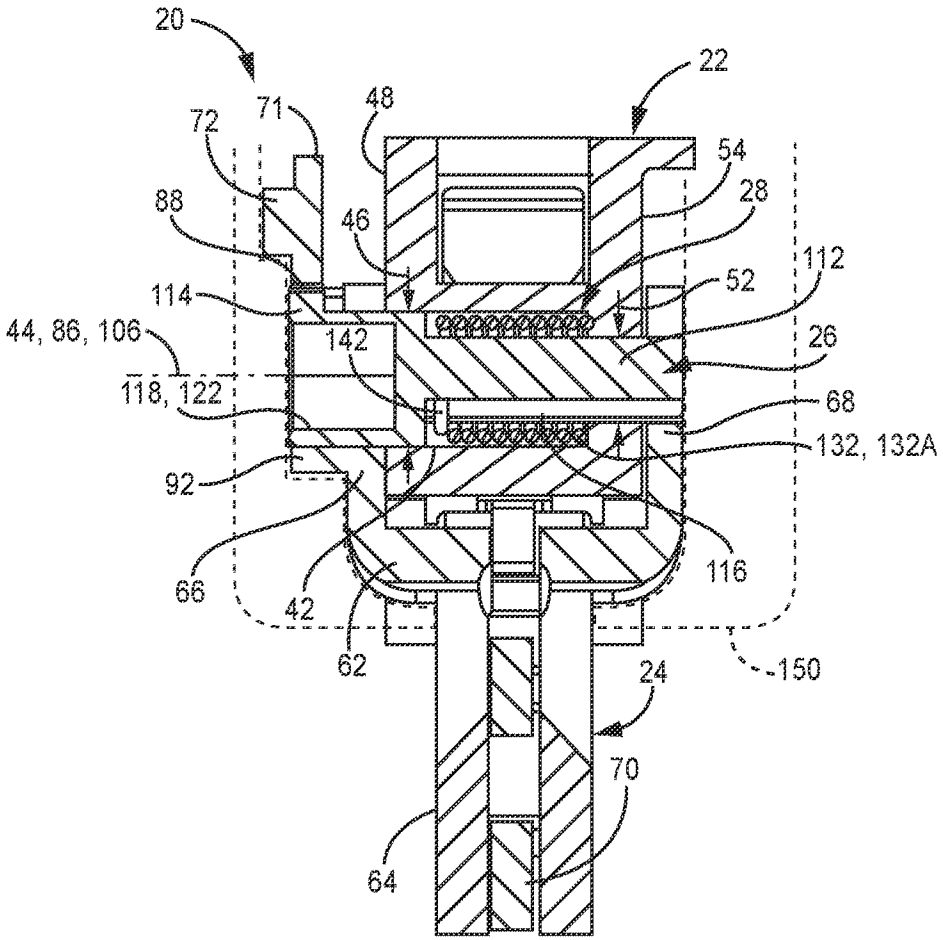
FIG. 5 is a sectional view at plane V-V of FIG. 4 according to an embodiment of the disclosure.
Figure 7:
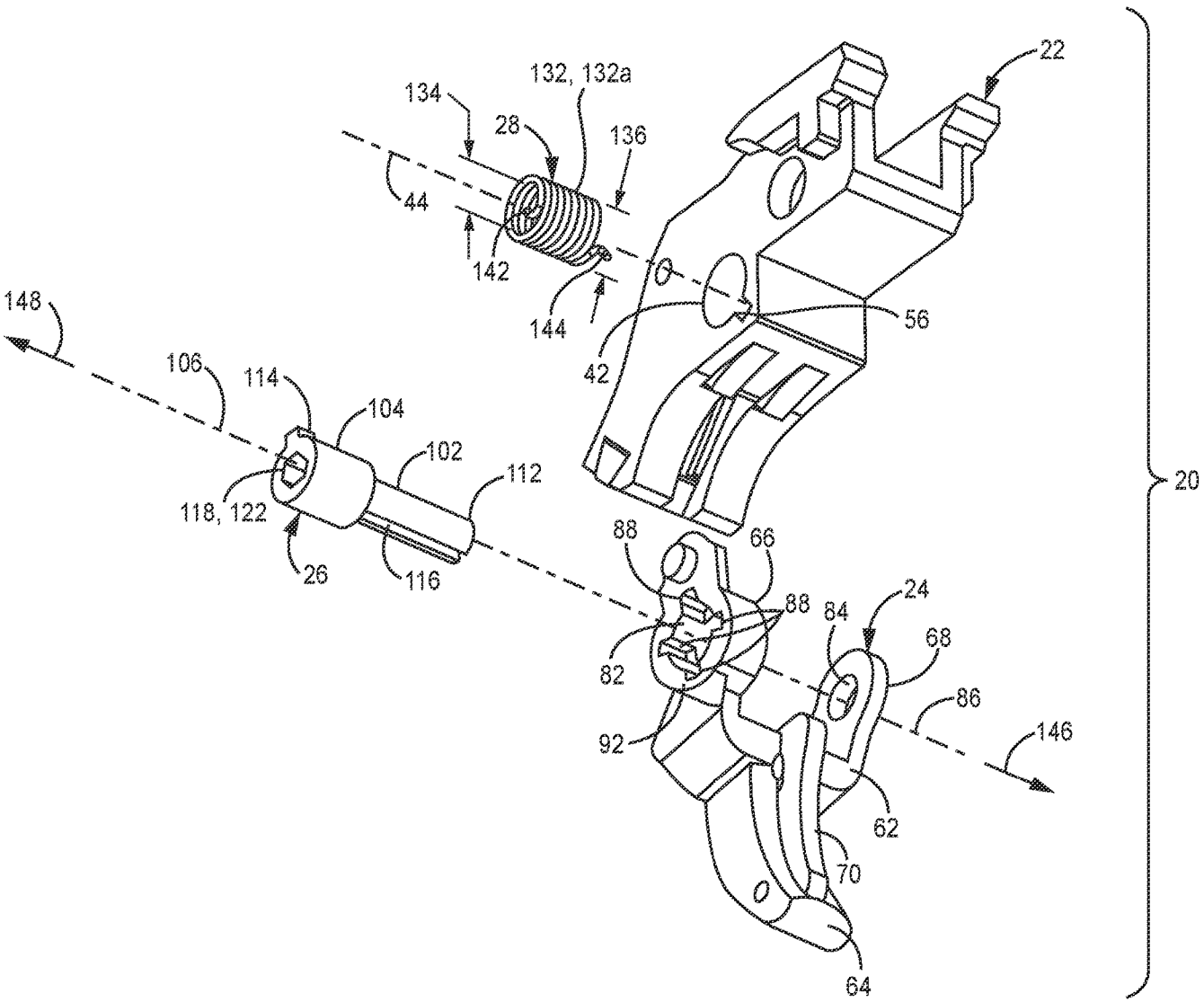
FIG. 7 is a lower perspective, partially exploded view of the trigger assembly of FIG. 1 according to an embodiment of the disclosure.
Figure 8:
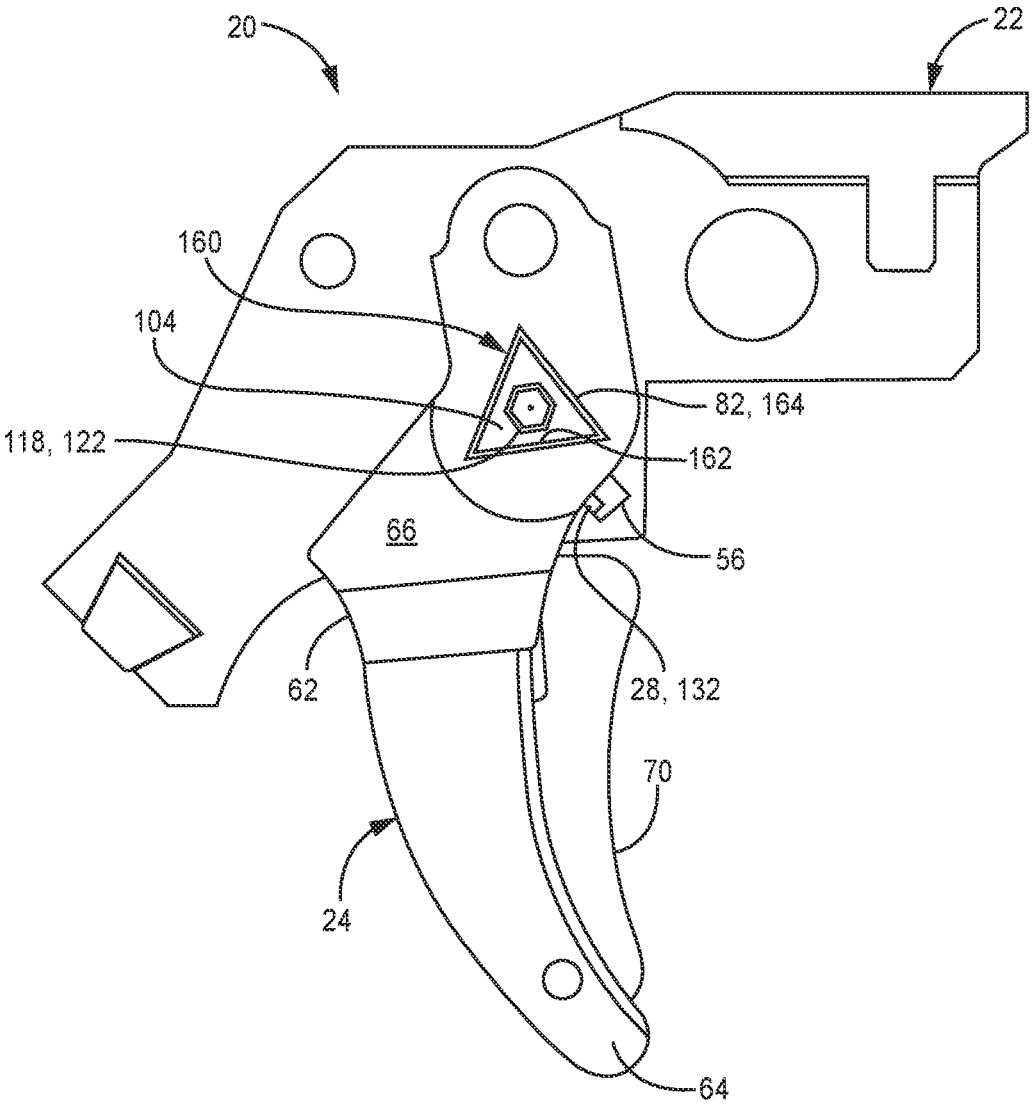
FIG. 8 is a side elevational view of a trigger assembly with a polygonal head seated within a polygonal recess according to an embodiment of the disclosure.
Figure 10:
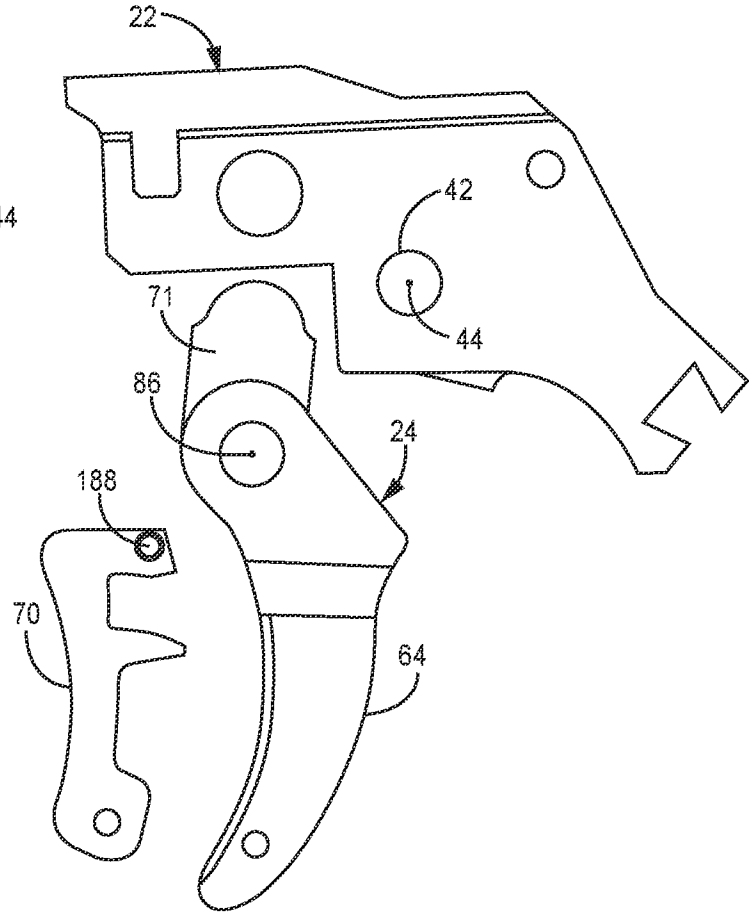
FIG. 10 is a side elevational view of the exploded view of FIG. 9.
Figure 9:
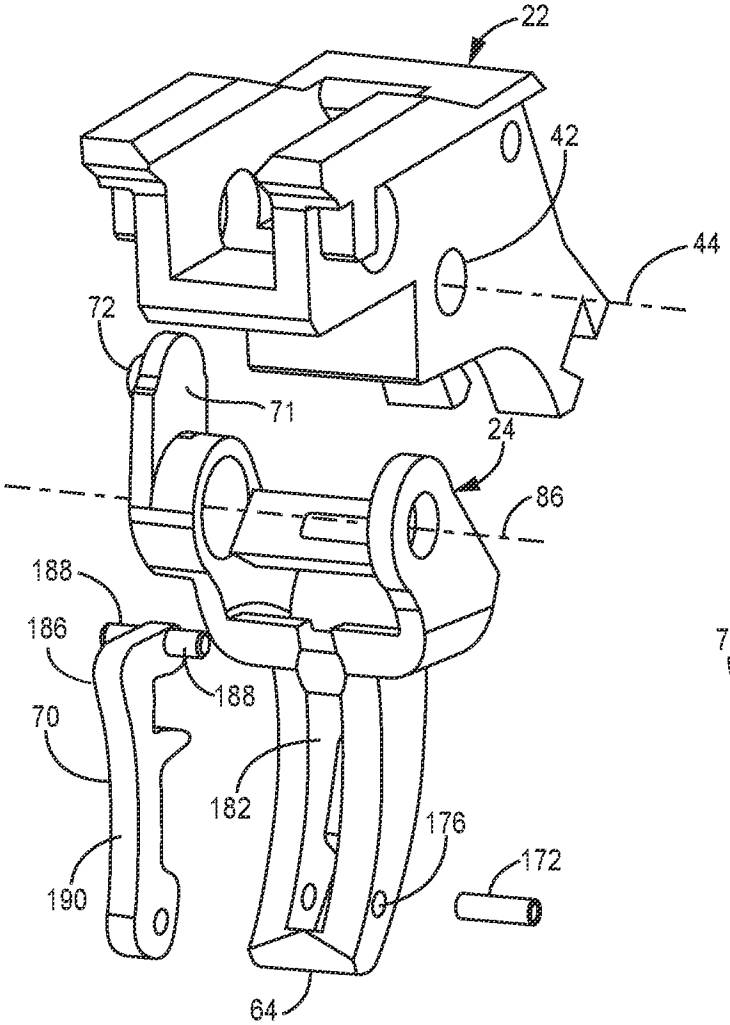
FIG. 9 is a perspective exploded view of particular components of the trigger assembly of FIG. 1.

Referring to FIG. 8, the use of polygonal shapes 160 for the head portion 104 and the first lateral through-passage 82 are also contemplated to provide rotational resolution for the indexing pin 26. That is, the head portion 104 may define a polygonal cross-section 162 with the lateral through-passage 82 defining a complementary polygonal recess 164. While the head portion 104 is polygonal, the shaft portion 102 may remain cylindrical, as depicted in FIGS. 5 and 7. In the depiction of FIG. 8, the polygonal cross-section 162 and the complementary polygonal recess 164 define equilateral triangles for a rotational resolution of 120 degrees. Other polygonal shapes 160 are also contemplated, for example: a square cross-section 162 that is seated within a square recess 164 to provide a rotational resolution of 90 degrees; a hexagonal cross-section 162 seated within a hexagonal (or triangular) recess 164 would provide a rotational resolution of 60 degrees; and so on. Operational steps for the head portions 104 and lateral through-passages 82 for the mating of the detent 114 and notch(es) 88 configuration, described above, are the same, mutatis-mutandis, as for the mating of the polygonal cross-section 162 and the complementary polygonal recess 164.

Referring to FIGS. 7 and 9-13, details of the safety trigger 70 according to an embodiment are depicted. The safety trigger has a lower pivot axis 170 defined by a pin 172 that extends through holes 176 in the lower leg portions 178, 179 of the main trigger 24, with the safety trigger slidingly and rotatably positioned in the slot 182 of the main trigger 24. The upper portion 186 of the safety trigger has a pair of stop portions 188 configured as cylindrical lugs that extend laterally from the main body portion 190 of the safety trigger. The stop portions fit into a pair of slots 194 defined by an upper surface of the main trigger body portion 190 and a lower surface of the trigger support frame 22.

Figures 11, 12, 13:
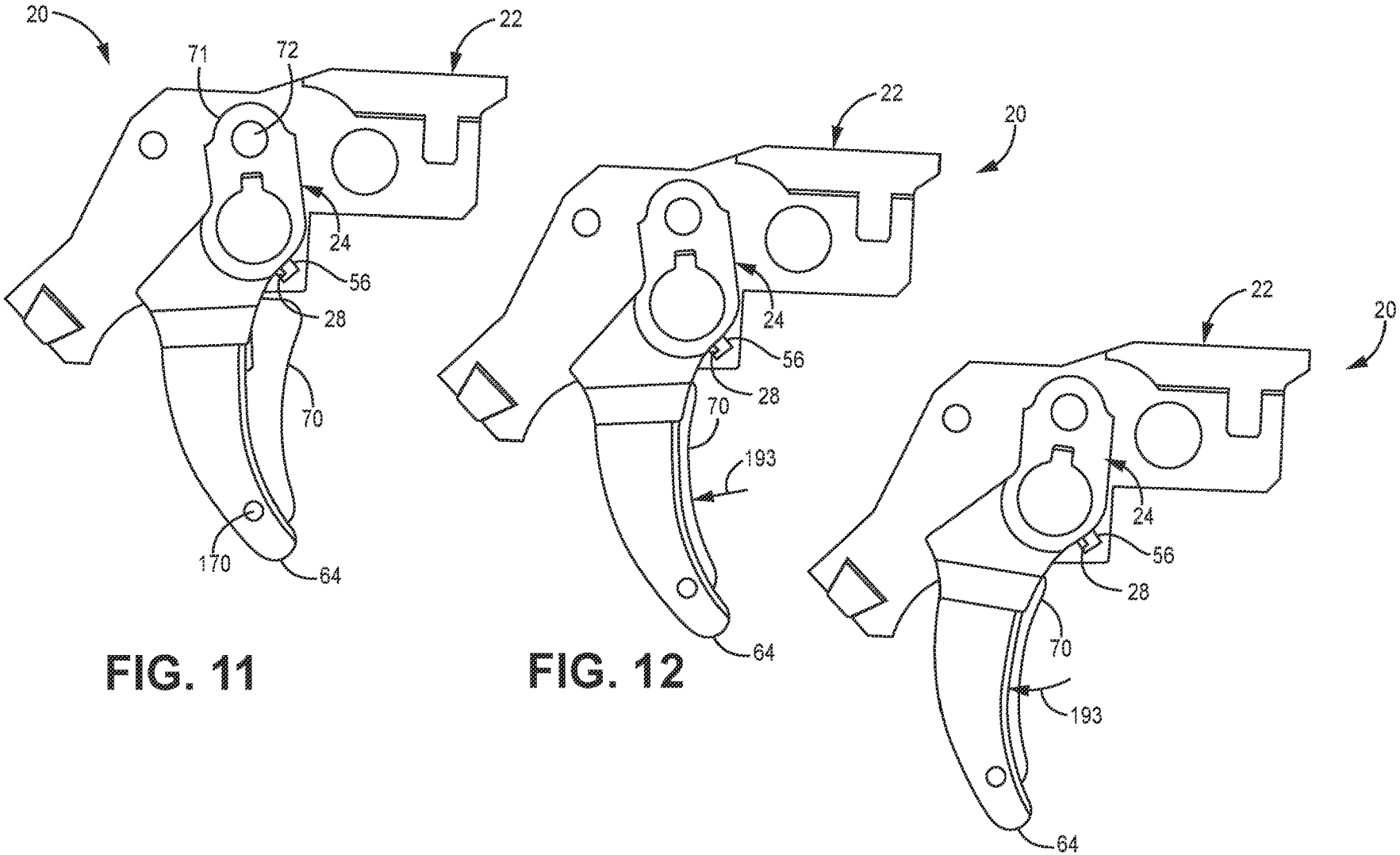
FIG. 11 is a side elevational view of the mechanism of FIG. 1.
FIG. 12 is a side elevational view of the mechanism of FIG. 11 with the safety trigger depressed.
FIG. 13 is a side elevational view of the mechanism of FIG. 11 with the main trigger depressed.
Figures 14, 15, 16:
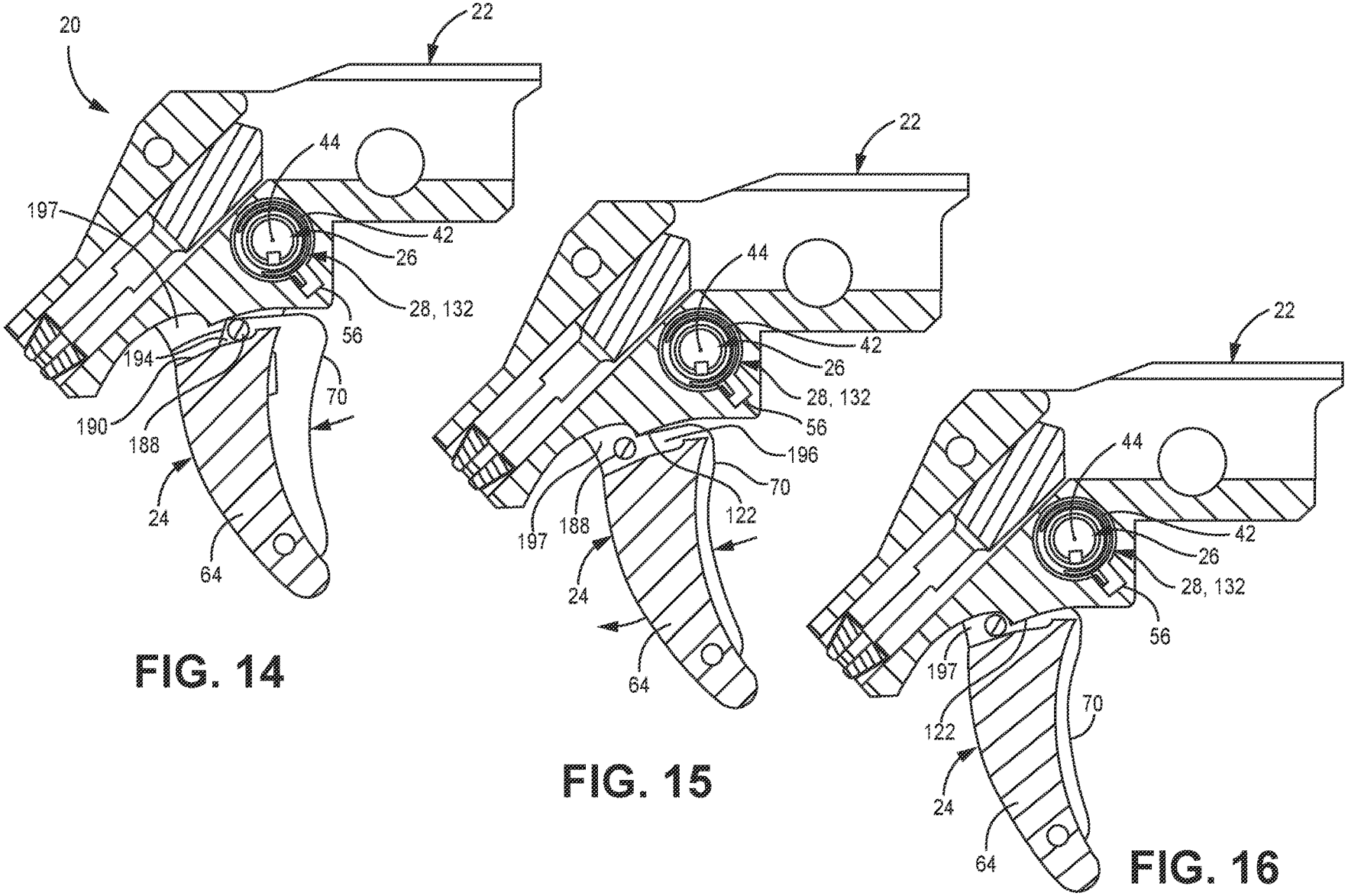
FIG. 14 is a cross sectional view taken at plane VI-VI of FIG. 3 reflecting the mechanism status of FIG. 11.
FIG. 15 is a cross sectional view taken at plane VI-VI of FIG. 3 reflecting the mechanism status of FIG. 12.
FIG. 16 is a cross sectional view taken at plane VI-VI of FIG. 3 reflecting the mechanism status of FIG. 13.

Referring to FIGS. 11 and 14, the undepressed trigger is illustrated, the arrow 193 illustrating pressure on the safety trigger causing the safety trigger to be retracted into the slot 182 in the main trigger. At this stage the stops are in the narrow portion 196 of the slots 194 and prevent rotation of the main trigger as the stop does not allow closure of the slot 194. In FIGS. 12, 13, 15, and 16, as the stops reach the widened portion 197 of the slots 194, the stops do not obstruct closure of the slot 194 and the main trigger is free to rotate rearward under trigger pull pressure.

Each of the additional figures and methods disclosed herein can be used separately, or in conjunction with other features and methods, to provide improved devices and methods for making and using the same. Therefore, combinations of features and methods disclosed herein may not be necessary to practice the disclosure in its broadest sense and are instead disclosed merely to particularly describe representative and preferred embodiments.

Various modifications to the embodiments may be apparent to one of skill in the art upon reading this disclosure. For example, persons of ordinary skill in the relevant arts will recognize that the various features described for the different embodiments can be suitably combined, un-combined, and re-combined with other features, alone, or in different combinations. Likewise, the various features described above should all be regarded as example embodiments, rather than limitations to the scope or spirit of the disclosure.

Persons of ordinary skill in the relevant arts will recognize that various embodiments can comprise fewer features than illustrated in any individual embodiment described above.

The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

Unless indicated otherwise, references to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A handgun, comprising a trigger mechanism with a main trigger and a safety trigger, the main trigger having a finger hook portion that depends from a trigger support frame of the handgun, the finger hook portion defining a first slot, the safety trigger being positioned in the first slot and being pivotal about a lower pivot axis that is proximate a lower margin of the finger hook portion, the safety trigger including a stop that precludes rearward movement of the main trigger until the safety trigger has been retracted into the slot, the safety trigger being actuated above the lower pivot axis to rotate the stop rearward about the lower pivot axis.

2. The handgun of claim 1, wherein the stop is positioned in a second slot that extends forward and rearward and is defined by an upper surface of the main trigger and the trigger support frame.

3. The handgun of claim 2, wherein the second slot defines a narrow portion and a widened portion, wherein:

when the safety trigger is undepressed, the stop is in the narrow portion and maintains separation between the main trigger and the trigger support frame, thereby precluding the rearward movement of the main trigger; and when the safety trigger is retracted into the first slot, the stop is in the widened portion and does not maintain separation between the main trigger and the trigger support frame, thereby enabling the rearward movement of the main trigger.

4. The handgun of claim 1, wherein the main trigger is pivotally coupled to the trigger support frame so that the rearward movement of the main trigger is a rotation.

5. The handgun of claim 1, wherein the lower pivot axis is defined by a pin supported by the finger hook portion of the main trigger.

6. The handgun of claim 5, wherein the pin passes through the safety trigger.

7. The handgun of claim 1, wherein the stop includes a cylindrical lug that extends parallel to the lower pivot axis.

8. The handgun of claim 1, wherein the safety trigger is adjacent the finger hook portion of the main trigger.

9. The handgun of claim 1, wherein the safety trigger is nested between leg portions of in the finger hook portion.

10. A handgun, comprising a trigger mechanism with a main trigger and a safety trigger, the main trigger having a finger hook portion that depends from a trigger support frame of the handgun, the finger hook portion defining a first slot, the safety trigger being positioned in the first slot and being pivotal about a lower pivot axis that is proximate a lower margin of the finger hook portion, the safety trigger including a stop that precludes rearward movement of the main trigger until the safety trigger has been retracted into the slot, wherein the stop includes a cylindrical lug that extends parallel to the lower pivot axis.

11. The handgun of claim 10, wherein the stop is positioned in a second slot that extends forward and rearward and is defined by an upper surface of the main trigger and the trigger support frame.

12. The handgun of claim 11, wherein the second slot defines a narrow portion and a widened portion, wherein:

when the safety trigger is undepressed, the stop is in the narrow portion and maintains separation between the main trigger and the trigger support frame, thereby precluding the rearward movement of the main trigger; and when the safety trigger is retracted into the first slot, the stop is in the widened portion and does not maintain separation between the main trigger and the trigger support frame, thereby enabling the rearward movement of the main trigger.

13. The handgun of claim 10, wherein the lower pivot axis is defined by a pin supported by the finger hook portion of the main trigger.

14. A handgun, comprising a trigger mechanism with a main trigger and a safety trigger, the main trigger having a finger hook portion that depends from a trigger support frame of the handgun, the finger hook portion defining a first slot, the safety trigger being positioned in the first slot and being pivotal about a lower pivot axis that is proximate a lower margin of the finger hook portion, the safety trigger including a stop that precludes rearward movement of the main trigger until the safety trigger has been retracted into the slot, wherein the stop is positioned in a second slot that extends forward and rearward and is defined by an upper surface of the main trigger and the trigger support frame.

15. The handgun of claim 14, wherein the second slot defines a narrow portion and a widened portion, wherein:

when the safety trigger is undepressed, the stop is in the narrow portion and maintains separation between the main trigger and the trigger support frame, thereby precluding the rearward movement of the main trigger; and when the safety trigger is retracted into the first slot, the stop is in the widened portion and does not maintain separation between the main trigger and the trigger support frame, thereby enabling the rearward movement of the main trigger.

16. The handgun of claim 14, wherein the main trigger is pivotally coupled to the trigger support frame so that the rearward movement of the main trigger is a rotation.

17. The handgun of claim 14, wherein the lower pivot axis is defined by a pin supported by the finger hook portion of the main trigger.

18. The handgun of claim 14, wherein the stop includes a cylindrical lug that extends parallel to the lower pivot axis.

* * * * *